US007020430B2

(12) United States Patent
Kudo et al.

(10) Patent No.: US 7,020,430 B2
(45) Date of Patent: Mar. 28, 2006

(54) IMAGE FORMING APPARATUS WITH REVERSING SECTION FOR SELECTIVE SHEET REVERSAL AND SHEET INSERTER

(75) Inventors: Toshihiko Kudo, Ibaraki (JP); Wataru Kawata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/454,574

(22) Filed: Jun. 5, 2003

(65) Prior Publication Data

US 2003/0235446 A1 Dec. 25, 2003

(30) Foreign Application Priority Data

Jun. 21, 2002 (JP) ..... 2002-180667

(51) Int. Cl.
*G03G 15/00* (2006.01)

(52) U.S. Cl. ..... 399/382; 399/388

(58) Field of Classification Search ..... 399/381, 399/382, 388, 391, 405, 401, 402
See application file for complete search history.

(56) References Cited

U.S. PATENT DOCUMENTS

| | | | | |
|---|---|---|---|---|
| 4,992,815 | A | 2/1991 | Kudo | 354/277 |
| 5,151,713 | A | 9/1992 | Kawasaki et al. | 346/108 |
| 5,166,738 | A * | 11/1992 | Tani | 399/402 |
| 5,210,616 | A | 5/1993 | Kawasaki et al. | 358/296 |
| 5,621,501 | A | 4/1997 | Matsuo et al. | 355/75 |
| 6,237,910 | B1 | 5/2001 | Kawata | 371/213 |
| 2001/0018626 | A1 | 8/2001 | Moriyama et al. | 700/223 |
| 2003/0170059 | A1 * | 9/2003 | Koga et al. | 399/381 |

FOREIGN PATENT DOCUMENTS

JP 2001-171894 6/2001

* cited by examiner

*Primary Examiner*—Ren Yan
(74) *Attorney, Agent, or Firm*—Fitzpatrick, Cella, Harper & Scinto

(57) ABSTRACT

An image forming apparatus has an image forming section for forming images on sheets; a sheet supply section for holding the sheets and supplying them to the image forming section; and a reverse section, disposed between the sheet supply section and the image forming section, for selectively reversing the sheets from the sheet supply section. An inserter set holds and supplies sheets for insertion between sheets having images formed thereon by the image forming section.

3 Claims, 7 Drawing Sheets

IMAGE FORMING APPARATUS WITH REVERSING SECTION FOR SELECTIVE SHEET REVERSAL AND SHEET INSERTER

BACKGROUND OF THE INVENTION

1. Field of the Invention

The present invention relates to an image forming apparatus, and, more particularly, to an image forming apparatus having a structure in which a sheet is inserted between sheets having images formed thereon by an image-forming section.

2. Description of the Related Art

Conventionally, in a copying machine, which is an example of an image forming apparatus, when a stack of originals including a plurality of types of originals (such as color originals and black-and-white originals) are copied, a user can obtain copies of color and black-and-white originals by copying all of the originals using a color copying machine. However, since it takes more time to carry out an image forming operation by a color copying machine than by a black-and-white copying machine, copying black-and-white originals with the color copying machine results in poor image-forming-operation efficiency. Consequently, there is a desire for copying black-and-white originals by a black-and-white copying machine.

To achieve this, color originals and black-and-white originals may be separately copied by copying the color originals with a color copying machine and copying the black-and-white originals with a black-and-white copying machine.

However, when these copying operations are carried out separately, the user must separate the color originals from the black-and-white originals prior to copying them, and, then, put them back into the original order after they have been copied. This is troublesome and time consuming to carry out particularly when the originals are not numbered or when there are many originals.

In order to put back the copies (sheets) from the color copying machine and the copies (sheets) from the black-and-white copying machine into their original order, for example, the copies from the color copying machine must be inserted between the copies from the black-and-white copying machine. The inserting operation is very complicated because it must be carried out by checking the original order of the originals.

Accordingly, the method of separately copying color originals with a color copying machine and black-and-white originals with a black-and-white copying machine has problems in that the operations that the user must carry out are sophisticated and tend to result in mistakes and are troublesome to carry out.

To overcome such problems, a copying machine which comprises a plurality of copying sections (such as a color copying section and a black-and-white copying section) and an inserter, including an inserter tray and a sheet feeder for feeding insertion sheets held by the inserter tray, and which copies various kinds of originals by the aforementioned parts, has been proposed. In general, the inserter tray is provided for supplying sheets that are inserted between sheets having images formed thereon by image-forming sections of the copying sections.

A structure of a copying machine (image-forming apparatus) comprising such an inserter is disclosed in, for example, Japanese Patent Laid-Open No. 2001-171894.

FIG. 7 is a sectional view of the entire structure of such a related copying machine (image-forming apparatus). A copying machine 1000 comprises a reader 101 (original reading means), a printer 102, a sheet processor 103, and an operating panel 40 for, for example, confirming operational settings and setting contents of the printer 102 and the sheet processor 103.

The reader 101 comprises an automatic original feeder 51, a lamp 79, a 3 CCD line sensor 76 (hereinafter referred to as the "CCD 76") for reading an image, reflective mirrors 72, 73, and 74, and a lens 75. The automatic original feeder 51 sends originals P set on an original setting tray 50 up to an original reading position, reads the originals P at the original reading position, and transports the originals P that have been read to a discharge position. The lamp 79 illuminates the originals P transported to the reading position and set on an original glass 78. The reflective mirrors 72, 73, and 74 guide light reflected from the originals P to the CCD 76. The lens 75 focuses the light reflected from the originals P.

An output signal from the CCD 76 is input to an image signal controlling section 77.

The originals P are set face-up on the original setting tray 50 by a user. The originals P set on the original setting tray 50 are successively read from a topmost original P by the reader 101.

The printer 102 comprises a plurality of sheet holders 53 and 54, and sheet feeders 55 and 56. A plurality of types of sheets S (S1 and S2) of the same size or different sizes can be loaded in the sheet holders 53 and 54. The sheet feeders 55 and 56 feed the sheets S. The sheets S fed from the sheet feeders 55 and 56 are transported to a sheet transportation path 60 through a sheet transportation path 57.

The printer 102 also comprises a laser scanner 61 and an image-forming section 62. Based on image information of an original P read by the reader 101, the laser scanner 61 scans the original P with laser light in order to form a latent image on a photosensitive member 62*a*. The image-forming section 62 forms a toner image on the photosensitive member 62*a* and transfers the toner image onto a sheet S to form an image thereon.

The sheet S having the image formed thereon by the image-forming section 62 is transported to a transportation path of the sheet processor 103 by a conveying belt 63, fixing rollers 64, and transportation rollers 65. The toner image on the sheet S is softened and fused and fixed to the sheet S by the fixing rollers 64.

The sheet processor 103 comprises a punching unit 50*a*, a buffer roller 5, pusher rollers 12, 13, and 14, and first and second change-over flappers 11 and 10. The punching unit 50*a* punches a hole near the back edge of an insertion sheet I or the sheet S having the image formed thereon. The buffer roller 5 is disposed in the transportation path of the sheet processor 103 and has a relatively large diameter. The pusher rollers 12, 13, and 14 are disposed along the outer periphery of the buffer roller 5 and push the sheet S against the surface of the buffer roller 5 for transporting the sheet S.

The first change-over flapper 11 is used for selectively switching between a non-sort path 35 and a sort path 36. The second change-over flapper 10 is used for switching between a buffer path 23 and the sort path 36. The buffer path 23 is used for temporarily keeping the sheet S or the insertion sheet I.

The sheet processor 103 also comprises transportation rollers 6, first discharge rollers 7, second discharge rollers 9, and a processing tray unit 84. The transportation rollers 6 are disposed at the sort path 36. The processing tray unit 84 comprises a processing tray 82, an aligning plate 88, a lower discharge roller 83*b*, and an upper discharge roller 83*a*. At the processing tray 82, the sheet S or the insertion sheet I is temporarily held, is aligned, and is stapled by a stapler unit 80. The aligning plate 88 aligns the sheet S or the insertion sheet I held by the processing tray 82.

The lower discharge roller 83*b* is secured to the discharge end of the processing tray 82. The upper discharge roller 83*a* is supported by a swinging guide 81. When the swinging guide 81 reaches its closed position, it presses against the lower discharge roller 83*b* in order to discharge a stack of sheets S or insertion sheets I onto the processing tray 82.

The first discharge rollers 7 are disposed at the sort path 36 and discharge the sheet S or the insertion sheet I onto a stack tray 86 through the processing tray 82. The second discharge rollers 9 are disposed at the non-sort path 35 and discharge the sheets S or insertion sheets I onto a sample tray 85.

The sheet processor 103 further comprises inserter trays 20, sheet-feed rollers 21, separating rollers 22, and inserters 104A to 104C having the same structures.

Here, an inserting operation refers to supplying the insertion sheets I which are held by the inserter trays 20 of the respective inserters 104A to 104C to the sample tray 85 or the stack tray 86 without passing them through the printer 102 (or by making them bypass the printer 102), and inserting the insertion sheets I between the sheets that are sent to the sheet processor 103 from the printer 102.

Each sheet-feed roller 21 feeds the insertion sheets I, is ordinarily in a waiting state at a position away from the insertion sheets I, and presses against the insertion sheets I when its associated sheet-feed solenoid 111 is turned on at a sheet-feed timing.

The separating rollers 22 separate the insertion sheets I fed from the respective sheet-feed rollers 21. The insertion sheets I separated by the separating rollers 22 are transported by the transportation rollers 23 to 26.

In the copying machine 1000 having such a structure, the user sets the originals P on the original setting tray 50 of the reader 101 or performs a desired setting operation on the copying machine 1000 from the operating unit 40 so as to fetch data from a network, and instructs the starting of an image-forming operation in order to start the image-forming operation.

Next, based on the instruction from the user, at the same time that the reader 101 reads the originals P or the data is fetched from the network, feeding of sheets S from the sheet holders 53 and 54 of the printer 102 is started in order to transport the sheets S to the image-forming section 62 through the sheet-transportation paths 57 and 60. In addition, data required for a sorting operation set by the operating unit 40 and an operation start signal are sent to the sheet processor 103 in order to start operation of the sheet processor 103.

Then, based on the image information read by the reader 101, toner images are transferred onto the sheets S transported to the image-forming section 62, after which the sheets S with the toner images pass between the fixing rollers 64 in order to fix the toner images to the sheets S. After fixing the toner images, the sheets S are transported to the sheet processor 103 and the insertion sheets I are inserted for performing punching, sorting, and stapling operations. By these operations, the insertion sheets I and the sheets S having the respective images formed thereon are set in a predetermined page order.

As mentioned above, the insertion sheets S are set in a face-up state by the user on the inserter trays 20 of their respective inserters 104A to 104C. The set insertion sheets I are successively fed starting from the topmost insertion sheets I by the sheet-feed rollers 21. Then, the insertion sheets I are transported to the sample tray 85 or the stack tray 86 through the transportation rollers 23, 24, and 25, so that the insertion sheets I are in a face-down state when they are discharged.

When, in the printer 102, the sheets S having the respective images formed thereon are sent in a face-down state to the sheet processor 103, after the sheets S have been temporarily sent towards the transportation rollers 66 disposed in a double-sided printing transportation path, the sheets S are reversed and transported to the sheet processor 103. In contrast, when, in the printer 102, the sheets S are sent in a face-up state to the sheet processor 103, the sheets S are transported to the sheet processor 103 without being sent towards the transportation rollers 66, that is, without being reversed.

Therefore, since the sheets S are discharged in a face-down state as described above when carrying out the inserting operation, the orientation of the sheets S is made the same as that of the insertion sheets I by reversing the sheets S and transporting them. Then, the sheets S are transported to the sheet processor 103, and are discharged in a face-down state onto the sample tray 85 or the stack tray 86.

In the copying machine (image-forming apparatus) described above, when the step of forming an image on one surface of a set insertion sheet is added (for example, when a black-and-white table of contents is to be printed on the back of a colored cover sheet), it is necessary to complete the formation of the image on the back of the insertion sheet with a black-and-white copying machine prior to setting the insertion sheet in the inserter.

This means that an additional image-forming step is required, so that there is still room for improving operation efficiency and usability of the copying machine.

SUMMARY OF THE INVENTION

The present invention has been achieved in view of the above-described problems and has as its object the provision of an image-forming apparatus which can form an image on an insertion sheet and which makes it possible to insert the insertion sheet between sheets without changing the page order.

To this end, according to a first aspect of the present invention, there is provided an image forming apparatus comprising an image forming section for forming images on sheets; a sheet supply section for holding the sheets and supplying them to the image forming section; and a reverse section, disposed between the sheet supply section and the image forming section, for selectively reversing the sheets supplied from the sheet supply section.

According to a second aspect of the present invention, there is provided an image forming apparatus comprising an image forming section for forming images on sheets; at least one inserter for holding and supplying insertion sheets for insertion between the sheets having the images formed thereon by the image forming section, in which the insertion sheets are transported to the image forming section from the inserter; a reverse section, disposed upstream from the image forming section in a sheet transportation direction, for selectively reversing the insertion sheets and supplying the reversed insertion sheets to the image forming section, the insertion sheets being used for forming images thereon by the image forming section; setting means for setting the image forming apparatus so that at least a predetermined one of the insertion sheets is reversed; and controlling means for controlling the reversing of at least the predetermined one of the insertion sheets by the reverse section based on the setting operation by the setting means.

According to a third aspect of the present invention, there is provided an image forming apparatus comprising an image forming section for forming images on sheets; an inserter set for holding and supplying insertion sheets for insertion between the sheets having the images formed thereon by the image forming section; and a reverse section for selectively reversing the insertion sheets from the inserter and supplying the reversed insertion sheets to the image forming section. In the image forming apparatus, the image forming section, the inserter set, and the reverse section are units that are removable from each other.

Further objects, features and advantages of the present invention will become apparent from the following description of the preferred embodiments with reference to the attached drawings.

DESCRIPTION OF THE PREFERRED EMBODIMENTS

A description of an image-forming apparatus of the preferred embodiments of the present invention will now be given. The present invention may be applied to a copying machine, a facsimile, a printer, and a combination of these devices, and to, for example, a printer for printing an image on a sheet such as a recording sheet.

Figure 1:
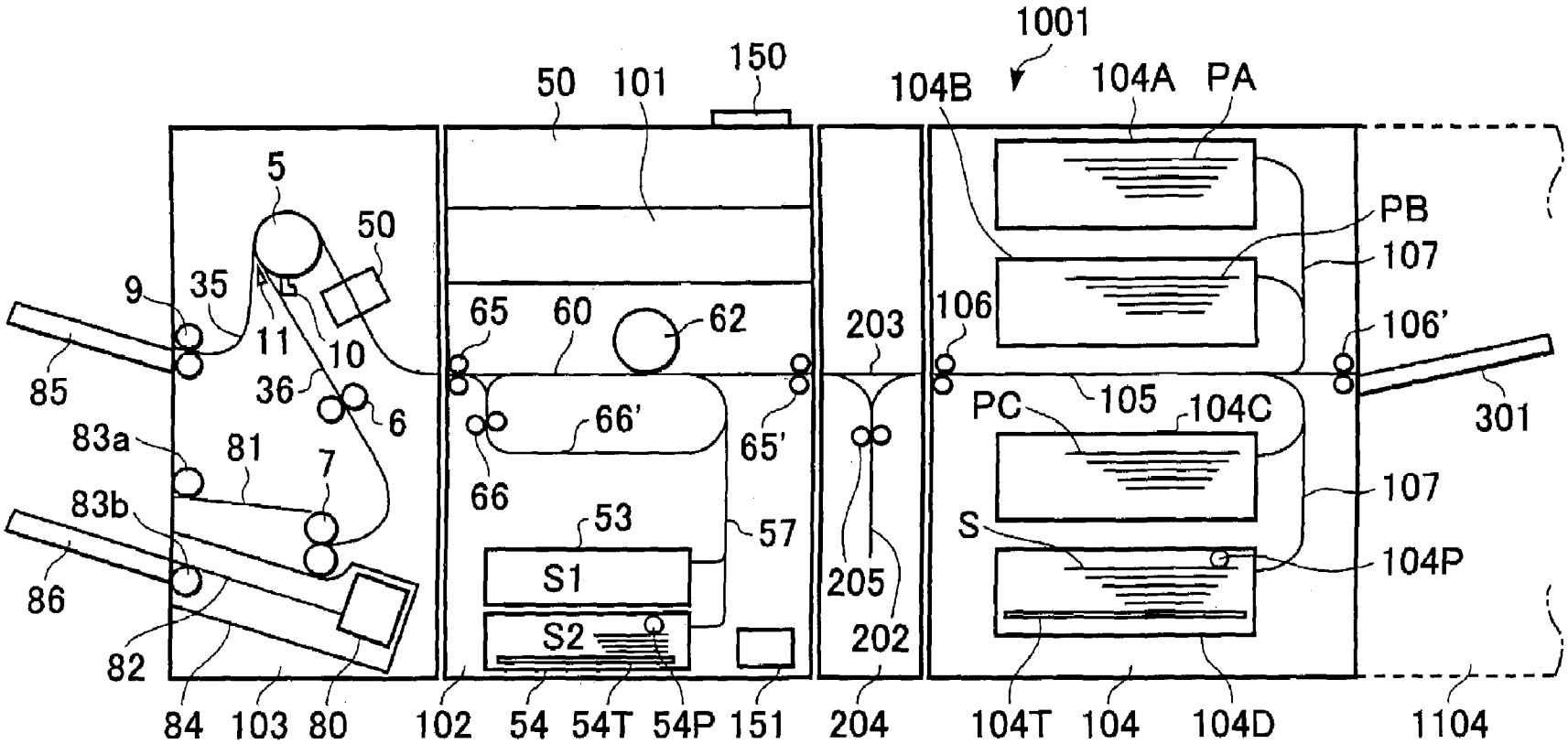
FIG. 1 is a schematic view of the structure of a copying machine, which is an example of an image-forming apparatus of a first embodiment of the present invention.
Figure 7:
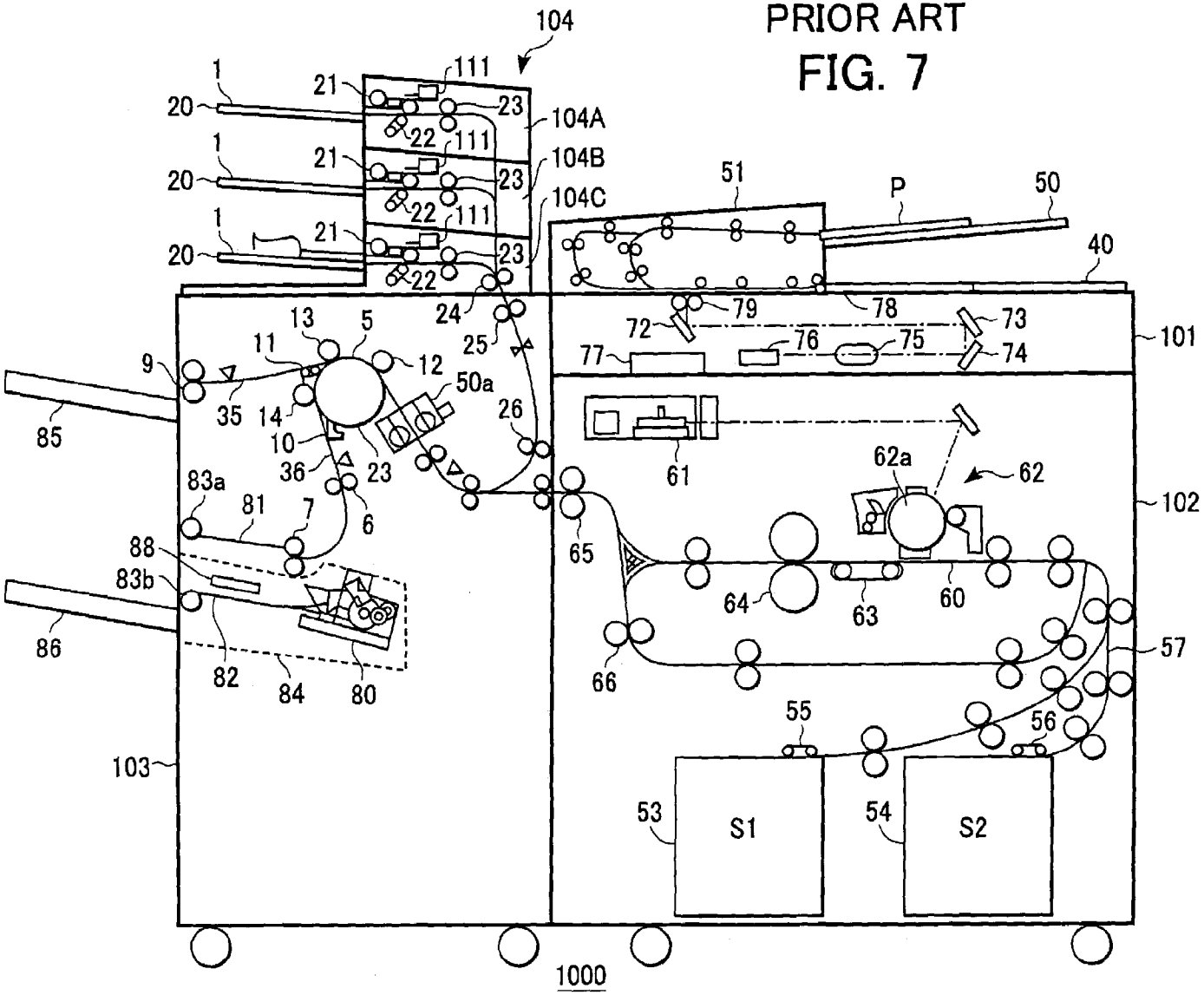
PRIOR ART FIG. 7
FIG. 7 shows the entire structure of a copying machine, which is an example of a related image-forming apparatus.

FIG. 1 is a schematic view of the structure of a copying machine, which is an example of an image-forming apparatus of a first embodiment of the present invention. Parts that are the same as or correspond to those shown in FIG. 7 are given the same reference numerals.

In FIG. 1, a copying machine 1001 comprises a reader 101 (original reading means), a printer 102, a sheet processor 103 serving as a discharge sheet loading means, an inserter set 104 comprising inserters 104A to 104D serving as sheet supply sections for holding and supplying cover sheets and slip sheets for insertion between a bundle of sheets, an operating unit 150, and controlling means 151. The operating unit 150 serves as setting means for, for example, confirming operation settings/setting contents of the printer 102 and the sheet processor 103. The controlling means 151 controls the operation of the entire image-forming apparatus 1001 by, for example, electric signals.

In the first embodiment, the printer 102, the sheet processor 103, and the inserter set 104 are each formed as a unit, and are connected so that they can be separated from each other. A reverse unit 204 serving as a reverse section for transporting insertion sheets from the inserter set 104 to the printer 102 by allowing them to pass therethrough after reversing the front and back of the insertion sheets or without reversing them is disposed between the inserter set 104 and the printer 102. The reverse section 204, disposed upstream from the printer 102, comprises a reversal path 202, a path 203, and reversing rollers 205. The reverse unit 204 is also formed as a unit and is detachably connected between the printer 102 and the inserter set 104.

A manual feed tray 301 for supplying recording sheets S and the insertion sheets to a transportation path 105 inside the inserter set 104 is disposed on the right side of the inserter-set 104. Lead-in rollers 106' for leading in the sheets S and insertion sheets manually fed from the manual feed tray 301 are disposed in the inserter set 104. The inserters 104A to 104D for holding and supplying the record sheets S and the insertion sheets are disposed above and below the transportation path 105. Although the manual feed tray 301 supplies the sheets S and the insertion sheets one at a time, it may be a multipurpose tray for setting a plurality of sheets and separately supplying them one at a time.

The inserters 104A to 104D each comprise a sheet tray and a pickup roller. (A sheet tray 104T and a pickup roller 104P of the inserter 104D are only shown in FIG. 1.) Each tray holds sheets. Each pickup roller is sheet feeding means for supplying the sheets held by its associated sheet tray. The inserters 104A to 104D have the same structure. The inserters 104A to 104D may also hold and supply the recording sheets S in addition to the insertion sheets.

Reference numeral 107 denotes a transit path for transporting the insertion sheets held by the inserters 104A to 104D to the transportation path 105. Discharge rollers 106 are disposed on the left end of the transportation path 105, and are used for discharging the recording sheets S and the insertion sheets from the inserters 104A to 104D.

Lead-in rollers 65', sheet feeders 53 and 54, transportation rollers 66, and transportation rollers 65 are disposed in the printer 102. The lead-in rollers 65' lead the recording sheets S and the insertion sheets into a sheet transportation path 60 at which the image-forming section 62 is disposed. The sheet feeders 53 and 54 hold and supply recording sheets S1 and S2. The transportation rollers 66 temporarily draw in and reverse the recording sheets S and the insertion sheets I and transport them outside the printer 102 or back to the image-forming section 62 for performing double-sided printing from a double-sided printing transportation path 66'. The transportation rollers 65 discharge the recording sheets S and the insertion sheets from the printer 102.

The sheet feeders 53 and 54 each comprise a sheet tray and a pickup roller. (A sheet tray 54T and a pickup roller 54P of the sheet feeder 54 are only shown.) The sheet trays hold the sheets S1 and S2, respectively. The pickup rollers are sheet-feeding means for sending out the sheets S1 and S2 held by the sheet trays.

The reader 101 and the original setting tray 50 are disposed at the upper portion of the printer 102. The sheet processor 103 is disposed to the left of the printer 102. The sheet processor 103 shown in FIG. 1 has a structure that is similar to that of the related sheet processor 103 shown in FIG. 7, and a general description thereof will be given below.

The sheet processor 103 comprises a punching unit 50, a buffer roller 5, a first change-over flapper 11, and a second change-over flapper 10. The punching unit 50 punches a hole near the back edge of each insertion sheet and each sheet having an image formed thereon. The buffer roller 5 is disposed in a transportation path and has a relatively large diameter. The first change-over flapper 11 selectively switches between a non-sort path 35 and a sort path 36. The second change-over flapper 10 switches between the sort path 36 and a buffer path 23 for temporarily keeping the sheets and the insertion sheets.

The sheet processor 103 further comprises transportation rollers 6, first discharge rollers 7, second discharge rollers 9, and a processing tray unit 84. The transportation rollers 6 are disposed at the sort path 36. The processing tray unit 84 comprises a processing tray 83, a lower discharge roller 83*b*, and an upper discharge roller 83*a*. At the processing tray 82, the sheets or the insertion sheets are temporarily kept, are aligned, and are stapled by a stapler unit 80.

The lower discharge roller 83*b* is fixedly disposed at the discharge end of the processing tray 82. The upper discharge roller 83*a* is supported by a swinging guide 81. When the swinging guide 81 reaches its closed position, it presses against the lower discharge roller 83*b* in order to discharge a stack of sheets S and insertion sheets I onto the processing tray 82.

The first discharge rollers 7 are disposed at the sort path 36 and discharge the sheets S and the insertion sheets I onto a stack tray 86 through the processing tray 82. The second discharge rollers 9 are disposed at the non-sort path 35 and discharge the sheets and insertion sheets onto a sample tray 85. Next, an image-forming operation and a binding operation of the copying machine 1001 having this structure will be described.

Prior to the image-forming operation, the recording sheets S1 and S2 without images formed thereon are set in the sheet feeders 53 and 54, respectively. Cover sheets PA which are subjected to color copying and whose back sides are to have tables of contents or the like printed thereon are set face up in the topmost inserter 104A. Back cover sheets PB whose back sides have printing on them and whose front sides are to be subjected to additional printing, such as printing of a postscript, are set face up in the inserter 104B (second inserter from the top). Printed slip sheets PC are set in the inserter 104C (the third inserter from the top). Sheets S not having any printing on them are set in the bottommost inserter 104D.

Next, an original P whose table of contents or the like is copied on the back (bottom side) of a cover sheet PA set in the inserter 104A is set on the original setting tray 50 of the reader 101 or a user performs a desired setting operation on the copying machine 1001 from the operating unit 150 in order to fetch data from a network.

Here, from the operating unit 150 to the system controlling means 151, the user inputs information regarding whether the top side, the bottom side, both sides, or neither side of the sheets S1 and S2 set in the sheet feeders 53 and 54 and the insertion sheets set in the inserters 104A to 104D is to be printed. Thereafter, using the operating unit 150, the user instructs the image-forming apparatus to start carrying out the image-forming operation, thereby starting the image-forming operation.

Figure 2:
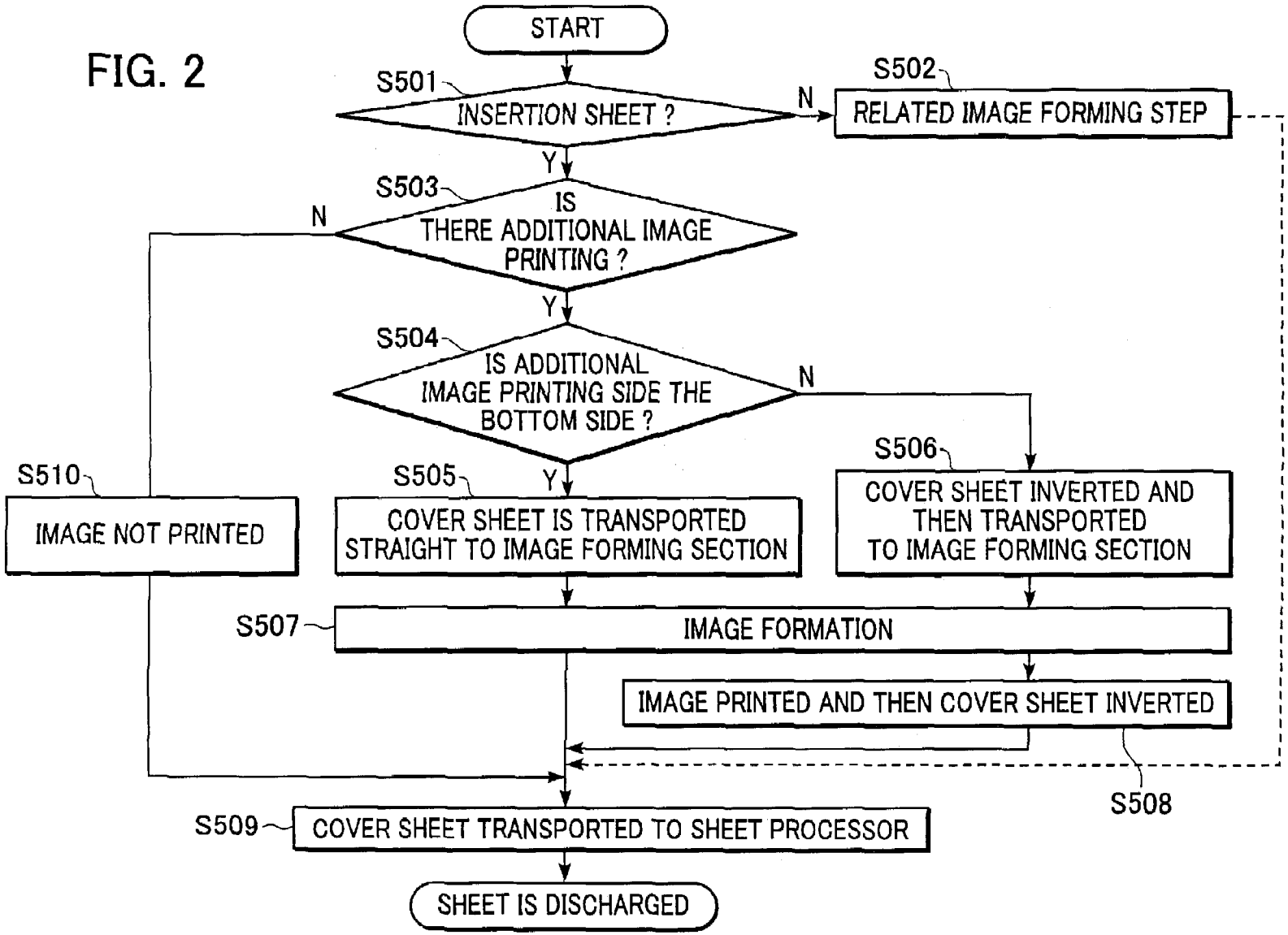
FIG. 2 is a flowchart of the general operation of the copying machine.

Next, the steps of the image-forming operation will be described with reference to the flowchart shown in FIG. 2.

(Cover Sheet Printing)

In order to print the table of contents on the back of the cover sheet PA in the inserter 104A based on the instruction from the user, at the same time that data concerning the table of contents of the original P is obtained from the reader 101 or the network, feeding of the cover sheet PA from the inserter 104A to the printer 102 is started. By this, the cover sheet PA is transported to the transportation path 105 through the transit path 107.

If the controlling means 151 determines that the cover sheet PA is an insertion sheet based on the previously input information (Step S501), and that the table of contents is to be printed on the back side, that is, that there is an additional image printing operation (Step S503) and that the additional image printing side is the back side (Step S504), the cover sheet PA is transported to the image-forming section 62 through a path 203 of the reverse unit 204, that is, the cover sheet PA is transported straight to the image-forming section 62 (Step S505).

Since, at this time, the back of the cover sheet PA is facing upward, an image, that is, the table of contents is printed on the back of the cover sheet PA at the image-forming section 62 (Step S507). Then, the cover sheet PA having the table of contents printed on the back side in this way passes along the sheet transportation path 60, is transported to the sheet processor 103, and is discharged face down onto the sample tray 85 (S509).

Here, it is possible to reverse the cover sheet PA after temporarily sending the cover sheet PA to the transportation rollers 66, transport the cover sheet PA back to the image-forming section 62 from the double-sided printing transportation path 66', superimpose characters upon each other for printing, reverse the cover sheet PA after temporarily re-sending the cover sheet PA to the transportation rollers 66, and discharge the cover sheet PA face down onto the sample tray 85.

It is also possible to feed the cover sheet PA face up from the manual feed tray 301. In this case, the cover sheet PA is transported to the transportation path 105 by the transportation rollers 106'. Then, if the controlling means 151 determines that the cover sheet PA is an insertion sheet (Step S501), and that the table of contents is to be printed on the back (that is, that there is an additional printing operation (Steps S503) and that the additional printing side is the back side (S504)), the cover sheet PA is drawn into the reversal path 202 by the reversing rollers 205 and is reversed by reverse rotation of the reversing rollers 205, after which the cover sheet PA is transported to the image-forming section 62 (Step S506). Then, the table of contents is printed (Step S507). After the printing, the cover sheet PA is inverted (Step S508) and transported to the sheet processor 103, and is discharged face down onto the sample tray 85 (Step S509).

(Printing of Text)

The printing of text is carried out by transporting the sheets S1 and S2 held by the respective sheet feeders 53 and 54 to the image-forming section 62 through the transportation path 57. Here, the controlling means 151 determines that the sheets S1 and S2 are not insertion sheets (Step S501), and a related image-forming step is carried out (Step S502).

In other words, when single-sided printing is carried out, images are formed on one side of the sheets S1 and S2 at the image-forming section 62. Then, the sheets S1 and S2 pass along the sheet transportation path 60, and are temporarily sent to the transportation rollers 66 and reversed. The reversed sheets S1 and S2 are transported towards the sheet processor 103 and discharged face down onto the sample tray 85 (Step S509).

When double-sided printing is carried out, after images have been formed on one side of the sheets S1 and S2 at the image-forming section 62, the sheets S1 and S2 pass along the sheet transportation path 60, and are temporarily sent to the transportation rollers 66 and reversed. The reversed sheets S1 and S2 are transported back to the image-forming section 62 from the double-sided printing transportation path 66', and the other side of the sheets S1 and S2 is printed. The sheets S1 and S2 having both sides printed are transported to the sheet processor 103, and discharged face down onto the sample tray 85 (Step S509).

The printing of text may be carried out using the sheets S set in the inserter 104D. In this case, the sheets S that are set in the inserter 104D are transported to the transportation path 105 through the transit path 107. From the transportation path 105, they are transported to the printer 102 through the path 203 in the reverse unit 204. Thereafter, if the controlling means 151 determines that the sheets S are not insertion sheets (Step S501), the subsequent steps that are performed on the sheets S1 and S2 are carried out.

(Insertion of Slip Sheet)

When a printed slip sheet PC set in the inserter 104C is to be inserted between the cover sheet PA and the sheets with the printed text, the controlling means 151 starts feeding the slip sheet PC at a predetermined timing from the inserter 104C, and transports it from the transit path 107 to the transportation path 105.

Here, if the controlling means 151 determines that the slip sheet PC is an insertion sheet (Step S501), and that there is no additional printing from the data input by the user (Step S503), the slip sheet PC is transported straight to the image-forming section 62 through the transit path 203 of the reverse unit 204. Then, the slip sheet PC passes along the sheet transportation path 60 without forming an image thereon, is transported to the sheet processor 103, and is discharged face down onto the sample tray 85 (Step S509). In this way, when the slip sheet PC that does not require an image-forming operation is transported, the image-forming section 62 does not perform the image-forming operation, so that the operation time can be reduced.

(Printing of Back Cover Sheet)

In order to perform additional printing, such as printing of a postscript, on the front of a back cover sheet PB set in the inserter 104B, at the same time that the data of the table of contents of the original P is obtained from the reader 101 or the network, feeding of the back cover sheet PB from the inserter 104B to the transit path 107 and to the reverse unit 204 through the transportation path 105 is started.

If the controlling means 151 determines that the back cover sheet PB is an insertion sheet (Step S501) and that printing of, for example, a postscript is to be performed on the top side (that is, that there is an additional printing operation in Step S503 and that the additional image printing side is not the bottom side in Step S504), the reversing rollers 205 of the reverse unit 204 draw the back cover sheet PB into the reversal path 202. Then, by reverse rotation of the reversing rollers 205, the back cover sheet PB is reversed and is transported to the image-forming section 62 (Step S506) for printing, for example, a postscript (Step S507).

Next, the back cover sheet PB passes along the sheet transportation path 60 and is temporarily sent to the transportation rollers 66 and reversed (Step S508). The reversed back cover sheet PB is transported to the sheet processor 103 and discharged face down onto the sample tray 85 (Step S509).

By carrying out the aforementioned steps, a bundle of insertion sheets (the cover sheet PA, slip sheet PC, and back cover sheet PB) and sheets S having images formed thereon can be obtained in a predetermined page order. Thereafter, the insertion sheets and the sheets S are bound by another process. Accordingly, the image-forming operation and the binding operation are completed.

In this way, in this embodiment, based on the setting by the operating unit 150, prior to the insertion of the cover sheet PA and the back cover sheet PB between sheets, the back cover sheet PB is reversed by the reverse unit 204 to form an image thereon. By this, it is possible to form the image and to insert the back cover sheet PB between the sheets without changing the page order.

In other words, in this embodiment, even if an image is formed on one side of the cover sheet PA and the back cover sheet PB, one set of output sheets can be easily provided in a desired page order by inputting page order information and information regarding whether or not an image-forming operation is to be carried out using the operating unit 150 when the insertion sheets set in the inserters 104A to 104C are output.

When the cover sheets PA and back cover sheets PB are held face down, the same advantages can be provided by carrying out the aforementioned controlling operation steps in the reverse order.

Like the inserter 104A used in the embodiment, any one of the other inserters 104B to 104D may be used for holding the recording sheets S.

In addition, it is possible to remove the manual feed tray 301 and to connect another inserter to the inserter set 104. In this case, an inserter 1104 (see FIG. 1) having the same structure as the inserter set 104 including the inserters 104B to 104D may be used as the inserter. By this, it is possible to hold the recording sheets S and insertion sheets of many types and sizes.

Next, a second embodiment of the present invention will be described.

Figure 3:
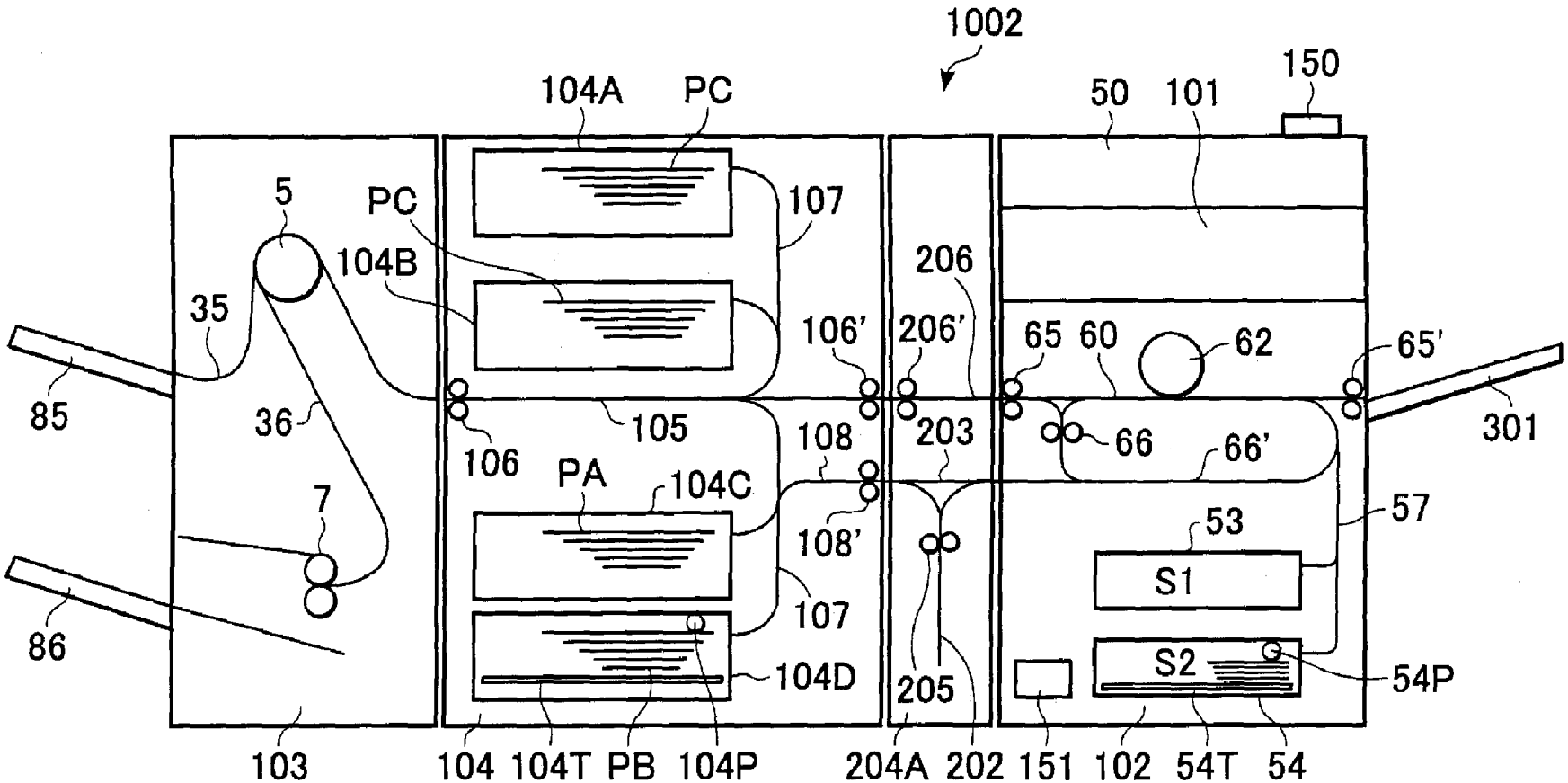
FIG. 3 is a schematic view of the structure of a copying machine, which is an example of an image-forming apparatus of a second embodiment of the present invention.

FIG. 3 is a schematic view of the structure of a copying machine, which is an example of an image-forming apparatus of the second embodiment of the present invention. In FIG. 3, the same reference numerals as those used in FIG. 1 refer to the same or corresponding parts. A sheet processor 103 has the same structure as that used in the first embodiment and will not be described below.

In FIG. 3, reference numeral 1002 denotes a copying machine, and reference numeral 204A denotes a reverse unit serving as reverse section. An inserter set 104 is disposed between the reverse unit 204A and the sheet processor 103. A printer 102 including a reader 101 and an original setting tray 50 is disposed opposite the inserter set 104. In other words, the inserter set 104 is disposed downstream from the printer 102. When the printer 102 is disposed in this manner, a manual feed tray 301 is mounted to the right side of the printer 102.

The reverse unit 204A includes a reversal path 202, a path 203, reversing rollers 205, and a transportation path 206 and transportation rollers 206' for transporting sheets S having images formed thereon by the printer 102. The inserter set 104 includes a transportation path 108 and transportation rollers 108'. The transportation path 108 branches from a transit path 107 and allows insertion sheets from the inserters 104C and 104D to be transported to the reversal path 202 of the reverse unit 204A. The transportation rollers 108' discharge the sheets from the transportation path 108. The transportation path 108, which branches from the transit path 107, has a flapper (not shown) at the branching section for selectively transporting the insertion sheets from the inserters 104C and 104D to either the reverse unit 204A or a transportation path 105.

By this, as described later, a cover sheet PA or a back cover sheet PB passes along the transportation path 108 and between the transportation rollers 108', is reversed by the reverse unit 204A functionally disposed upstream from image-forming section 62, and is transported to the image-forming section 62.

Since the structures of the inserters 104A to 104D of the inserter set 104 and the sheet feeders 53 and 54 of the printer 102 have the same structures as those used in the first embodiment, they will not be described below.

Next, an image-forming operation and a binding operation of the copying machine 1002 having such a structure will be described.

Prior to the image-forming operation, recording sheets S1 and S2 are set in the sheet feeders 53 and 54. Slip sheets PC with printing on them or cover sheets PA which are subjected to color copying and whose back sides are to have tables of contents or the like printed thereon are set in a face up state in the inserters 104B and 104A, respectively. Back cover sheets PB whose back sides have printing on them and whose front sides are subjected to additional printing, such as printing of a postscript, are set in a face up state in the inserter 104D.

Next, an original P whose table of contents is copied on the back (bottom side) of a cover sheet PA set in the inserter 104C is set on the original setting tray 50 of the reader 101 or a user performs a desired setting operation on the copying machine 1002 from an operating unit 150 in order to obtain data from a network.

Here, from the operating unit 150 to system controlling means 151, the user inputs information regarding whether the top side, the bottom side, both sides, or neither side of the recording sheets S set in the sheet feeders 53 and 54 and the insertion sheets set in the inserters 104A to 104D is to be printed. Thereafter, using the operating unit 150, the user instructs the image-forming apparatus to start carrying out the image-forming operation, thereby starting the image-forming operation.

Figure 4:
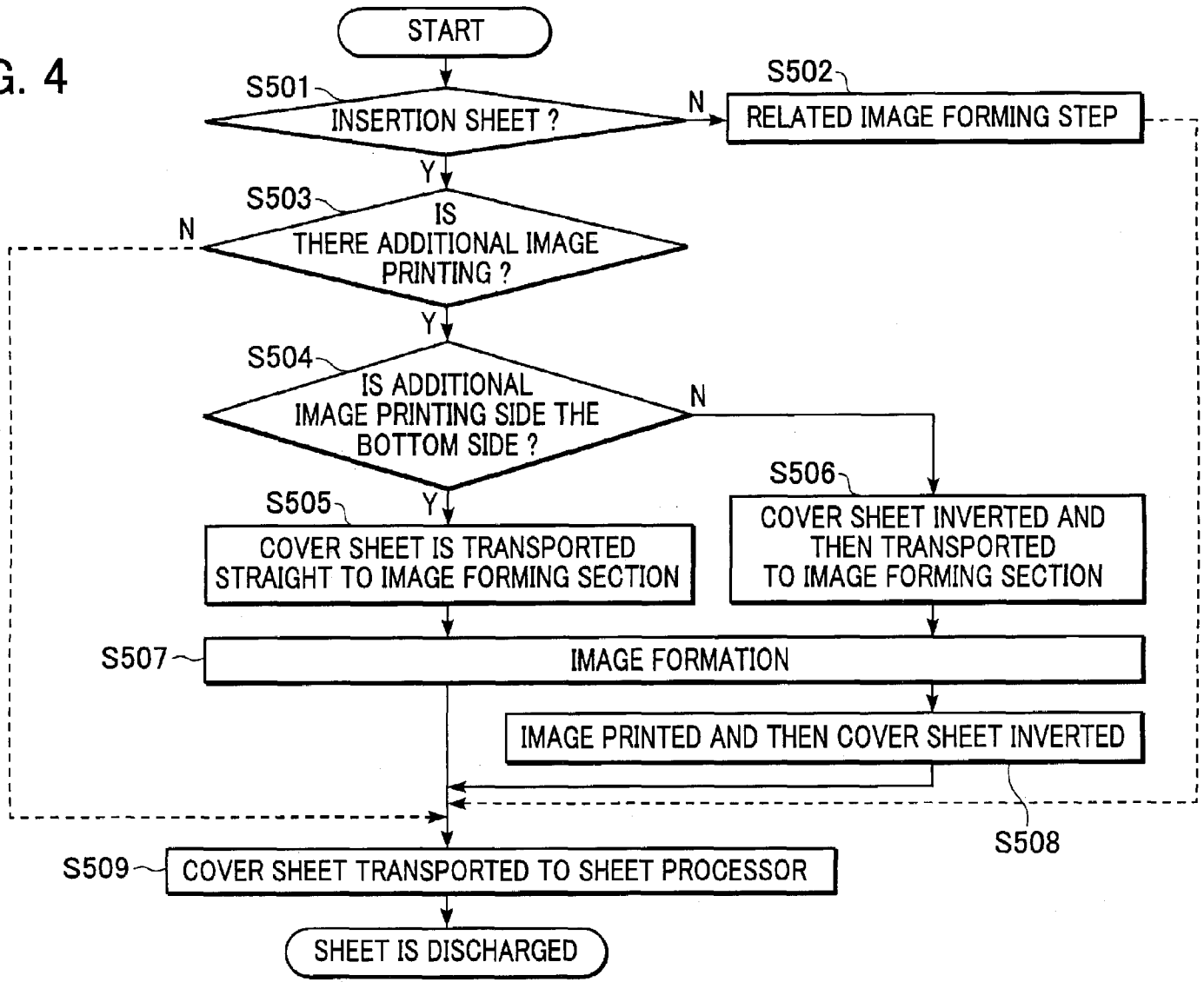
FIG. 4 is a flowchart of the general operation of the copying machine.

Next, the steps of the image-forming operation will be described with reference to the flowchart shown in FIG. 4.

(Cover Sheet Printing)

In order to print the table of contents on the back of the cover sheet PA in the inserter 104C based on the instruction from the user, at the same time that data concerning the table of contents of the original P is obtained from the reader 101 or the network, the cover sheet PA is transported to a double-sided printing transportation path 66' of the printer 102, connected to the path 203, from the inserter 104C through the transit path 107, the transportation path 108, the transportation rollers 108', and the transit path 203 of the reverse unit 204A.

If the controlling means 151 determines that the cover sheet PA is an insertion sheet (Step S501) and that the table of contents is to be printed on the back of the cover sheet PA (that is, that there is an additional image printing operation (Step S503) and that the additional image printing side is the bottom side (Step S504)), the cover sheet PA is transported straight to the image-forming section 62 (Step S505), and the table of contents is printed on the cover sheet PA having its back side faced upward (Step S507).

Next, the cover sheet PA having the table of contents printed on its back side in this way passes along a sheet transportation path 60, through the transportation path 206 of the reverse unit 204A, between the transportation rollers 206', and the transportation path 105 of the inserter set 104. Then, the cover sheet PA is transported to the sheet processor 103, and is discharged face down onto a sample tray 85 (Step S509).

Here, as already mentioned in the first embodiment, it is possible to reverse the cover sheet PA after temporarily sending the cover sheet PA to the transportation rollers 66, transport the cover sheet PA back to the image-forming section 62 from the double-sided printing transportation path 66', superimpose characters upon each other for printing, reverse the cover sheet PA after temporarily sending the cover sheet PA to the transportation rollers 66, make the cover sheet PA pass along the transportation path 206 and between the transportation rollers 206' of the reverse unit 204A and through the transportation path 105 of the inserter set 104, and discharge the cover sheet PA face down onto the sample tray 85.

If the cover sheet PA is set face down from the manual feed tray 301, the cover sheet PA is transported to the printer 102 by transportation rollers 65'. If the controlling means 151 determines that the cover sheet PA is an insertion sheet (Step S501) and that the table of contents is to be printed on the back of the cover sheet PA (that is, that there is an additional image printing operation (Step S503) and that the additional image printing side is the bottom side (Step S504)), the cover sheet PA is transported straight to the image-forming section 62 (Step S505), and the table of contents is printed (Step S507).

Next, the cover sheet PA having the table of contents printed on the back in this way passes along the sheet transportation path 60, through the transportation path 206 and between the transportation rollers 206' of the reverse unit 204A, and through the transportation path 105 of the inserter set 104. Then, by transporting the cover sheet PA to the sheet processor 103, it can be discharged face down onto the sample tray 85.

By constructing the image-forming apparatus 1002 so that the cover sheet PA inserted from the manual feed tray 301 in this manner can be transported to the sheet processor 103 without making it pass through the reverse unit 204A, even if the cover sheet PA is a thick sheet, the image forming operation and the transportation of the sheet can be carried out without jamming or the like.

(Printing of Text)

The printing of text is carried out by transporting the sheets S1 and S2 held by the respective sheet feeders 53 and 54 to the image-forming section 62 through the transportation path 57. Here, the controlling means 151 determines that the sheets S1 and S2 are not insertion sheets (Step S501), and a related image-forming step is carried out (Step S502).

In other words, when single-sided printing is carried out, images are formed on one side of the sheets S1 and S2 at the image-forming section 62. Then, the sheets S1 and S2 pass along the sheet transportation path 60, through the transportation path 206 and between the transportation rollers 206' of the reverse unit 204A, and through the transportation path 105 of the inserter set 104. Then, the sheets S1 and S2 are transported to the sheet processor 103, and are discharged face down onto the sample tray 85 (Step S509).

When double-sided printing is carried out, after images have been formed on one side of the sheets S1 and S2 at the image-forming section 62, the sheets S1 and S2 pass along the sheet transportation path 60, and are temporarily sent to the transportation rollers 66 and reversed. The reversed sheets S1 and S2 are transported back to the image-forming section 62 from the double-sided printing transportation path 66', and the other side of each of the sheets S1 and S2 is printed. Then, the sheets S1 and S2 pass along the transportation path 206 and between the transportation rollers 206' of the reverse unit 204A, and through the transportation path 105 of the inserter set 104. Thereafter, the sheets S1 and S2 are transported to the sheet processor 103, and discharged face down onto the sample tray 85 (Step S509).

The text can be printed by setting the sheets S in the inserter 104C or the inserter 104D. In this case, the sheets S set in the inserter 104D or the inserter 104C are transported to the double-sided printing transportation path 66' of the printer 102 through the transit path 107, the transportation path 108 and the transportation rollers 108', and the path 203 of the reverse unit 204A. After transporting the sheets S, the controlling means 151 determines that the sheets S are not insertion sheets (Step S501), and a related image-forming step is carried out (Step S502).

(Insertion of Slip Sheets)

When printed slip sheets PC set in the inserter 104A and the inserter 104B are inserted between the cover sheet PA and the sheets with the printed text, the controlling means 151 starts feeding the slip sheets PC at a predetermined timing from the inserter 104A and the inserter 104B, and transports them from the transit path 107 to the transportation path 105 without transporting them to the image-forming section 62.

In other words, if the controlling means 151 determines that the slip sheets PC are insertion sheets (Step S501) and that there is no additional printing from the data input by the user (Step S503), the slip sheets PC are transported to the sheet processor 103, and are discharged face down onto the sample tray 85 (Step S509).

In the second embodiment, it is possible to set the printed slip sheets PC in the inserter 104C or the inserter 104D. In this case, if the controlling means 151 determines that the slip sheets PC are insertion sheets (Step S501) and that there is no additional printing from the data input by the user (Step S503), it is possible to make the process proceed as shown by the broken lines in FIG. 4. Here, the slip sheets PC are transported to the transportation path 105 from the transit path 107 without transporting them to the image-forming section 62. Then, the slip sheets PC are transported directly to the sheet processor 103 (Step S509), and are discharged face down onto the sample tray 85.

(Printing of Back Cover Sheet)

In order to perform additional printing, such as printing of a postscript, on the front of a back cover sheet PB set in the inserter 104D, at the same time that the data of the table of contents of the original P is obtained from the reader 101 or the network, feeding of the back cover sheet PB to the printer 102 from the inserter 104D is started. In other words, the back cover sheet PB set in the inserter 104D is transported to the transportation path 108 and the transportation rollers 108' through the transit path 107.

If the controlling means 151 determines that the back cover sheet PB is an insertion sheet (Step S501) and that printing of, for example, a postscript is to be performed on the front side (that is, that there is an additional printing operation in Step S503 and that the additional image printing side is not the bottom side in Step S504), the reversing rollers 205 of the reverse unit 204A draw the back cover sheet PB into the reversal path 202. Then, by reverse rotation of the reversing rollers 205, the back cover sheet PB is reversed and is transported to the image-forming section 62 from the double-sided printing transportation path 66' of the printer 102 (Step S506), and a postscript or the like is printed (Step S507).

Next, the back cover sheet PB passes along the sheet transportation path 60 and is temporarily sent to the transportation rollers 66 and reversed (Step S508). Then, the back cover sheet PB passes along the transportation path 105 of the inserter set 104, is transported to the sheet processor 103, and is discharged face down onto the sample tray 85 (Step S509).

By carrying out the aforementioned steps, a bundle of insertion sheets (the cover sheet PA, slip sheets PC, and back cover sheet PB) and sheets S having images formed thereon can be obtained in a predetermined page order. Thereafter, the insertion sheets and the sheets S are bound as in the first embodiment. Accordingly, the image-forming operation and the binding operation are completed.

By virtue of the structure of the image-forming apparatus of the second embodiment, it is possible to provide the following advantage in addition to the advantages provided by the first embodiment. If it is not necessary to perform an image-forming operation (such as when a slip sheet PC is being used), or if it is not necessary to form an image on the front or back of the cover sheet PA or the back cover sheet PB, the slip sheet PC, the cover sheet PA, or the back cover sheet PB does not pass by the image-forming section 62, so that corresponding controlling operations and steps do not need to be carried out, thereby making it possible to reduce operation time.

Next, a description of a third embodiment of the present invention will be given.

Figure 5:
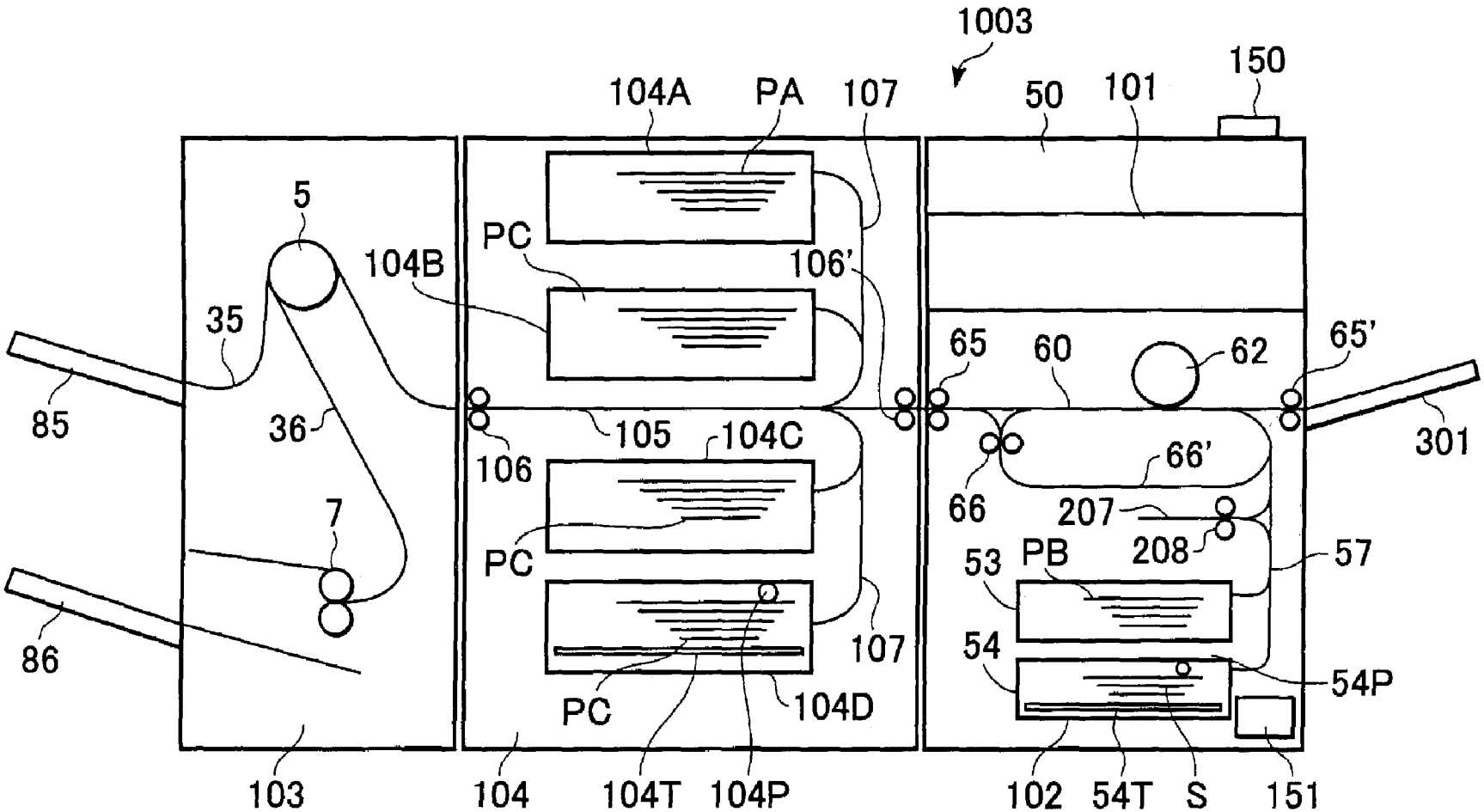
FIG. 5 is a schematic view of the structure of a copying machine, which is an example of an image-forming apparatus of a third embodiment of the present invention.

FIG. 5 is a schematic view of the structure of a copying machine, which is an example of an image-forming apparatus of a third embodiment of the present invention. In FIG. 5, the same reference numerals as those used in FIG. 3 refer to the same or corresponding parts. A sheet processor 103 has the same structure as that used in the first embodiment and will not be described below.

In FIG. 5, reference numeral 1003 denotes a copying machine. In the embodiment, an inserter set 104 is disposed between the sheet processor 103 and a printer 102 comprising a reader 101 and an original setting tray 50. Reference numeral 207 denotes a reversal path, and reference numeral 208 denotes reversing rollers. The reversal path 207 and the reversing rollers 208 are disposed at a transportation path 57 situated upstream from an image-forming section 62. In other words, in the embodiment, a reverse section is formed by the reversal path 207 and the reversing rollers 208. A flapper (not shown) is disposed at the entrance of the reversal path 207 of the reverse section, so that sheets can be selectively transported to the image-forming section by transporting them to the reversal path 207 or by passing them through the reverse section.

Since inserters 104A to 104D of the inserter set 104 and sheet feeders 53 and 54 of the printer 102 have the same structures as the corresponding elements in the first embodiment, they will not be described below.

In the third embodiment, images are only formed on back cover sheets PB, and the back cover sheets PB that need to be subjected to an image-forming operation are set in either one of the sheet feeders 53 and 54.

Next, an image-forming operation and a binding operation of the copying machine 1003 having such a structure in accordance with the third embodiment will be described.

First, prior to the image-formation operation, printed back cover sheets PB are set in a face up state in the sheet feeder 53, and recording sheets R are set in the sheet feeder 54. Printed cover sheets PA are set face up in the inserter 104A, and printed slip sheets PC are set face up in the inserters 104B to 104D.

Here, from an operating unit 150 to controlling means 151, a user inputs information regarding whether the top side, the bottom side, both sides, or neither side of the back cover sheets PB set in the sheet feeder 53, the recording sheets S set in the sheet feeder 54, and the insertion sheets set in the inserters 104A to 104D is to be printed. Thereafter, using the operating unit 150, the user instructs the image-forming apparatus to start carrying out the image-forming operation, thereby starting the image-forming operation.

Next, the steps of the image-forming operation will be described with reference to the flowchart shown in FIG. 4.

(Cover Sheet Printing)

First, based on an instruction from the user, a printed cover sheet PA set in the inserter 104A is transported to a transit path 107. Here, if the controlling means 151 determines that the cover sheet PA is an insertion sheet (Step S501), and that a printing operation is not required (Step S503), the operation proceeds as indicated by the broken lines in FIG. 4. Here, the cover sheet PA is transported to a transportation path 105 of the inserter set 104. Then, the cover sheet PA is transported to the sheet processor 103 and is discharged face down onto the sample tray 85 (Step S509).

(Printing of Text)

The printing of text is carried out by transporting the sheets S held by the sheet feeder 54 to the image-forming section 62 through the transportation path 57. Here, the controlling means 151 determines that the sheets S are not insertion sheets (Step S501), and a related image-forming step is carried out (Step S502).

In other words, when single-sided printing is carried out, an image is formed on one side of each of the sheets S at the image-forming section 62. Then, the sheets S pass along a sheet transportation path 60 and the transportation path 105 of the inserter set 104, are transported towards the sheet processor 103, and are discharged face down onto a sample tray 85 (Step S509).

When double-sided printing is carried out, after an image has been formed on one side of each sheet S at the image-forming section 62, the sheets S pass along the sheet transportation path 60, and is temporarily sent to transportation rollers 66 and are reversed. The reversed sheets S are transported back to the image-forming section 62 from a double-sided printing transportation path 66', and the other side of each sheet S is printed. Then, the sheet S having both sides printed are temporarily sent again to the transportation rollers 66 and reversed. After this, the sheets S pass along the transportation path 105 of the inserter set 104, are transported to the sheet processor 103, and are discharged face down onto the sample tray 85 (Step S509).

(Insertion of Slip Sheets)

When the printed slip sheets PC set in the inserters 104B to 104D are inserted between the cover sheet PA and the sheets S with the printed text, the controlling means 151 starts feeding the slip sheets PC at a predetermined timing from the inserters 104B to 104D, and transports them to the transit path 107 and the transportation path 105.

Here, if the controlling means 151 determines that the slip sheets PC are insertion sheets (Step S501), and that there is no additional printing from data input by the user (Step S503), the slip sheets PC pass along the transportation path 105 of the inserter set 104. Then, the slip sheets PC are transported to the sheet processor 103 and are discharged face down onto the sample tray 85 (Step S509).

(Printing of Back Cover Sheet)

In order to perform additional printing, such as printing of a postscript, on the front of a back cover sheet PB set in the sheet feeder 53, at the same time that data of the table of contents of an original P is fetched from the reader 101 or a network, feeding of the back cover sheet PB from the sheet feeder 53 to the transportation path 57 is started.

If the controlling means 151 determines that the back cover sheet PB is an insertion sheet (Step S501) and that printing of, for example, a postscript is to be performed on the front side (that is, that there is an additional printing operation in Step S503 and that the additional image printing side is not the bottom side in Step S504), the reversing rollers 208 draw the back cover sheet PB into the reversal path 207. Then, by reverse rotation of the reversing rollers 208, the back cover sheet PB is reversed and is transported to the image-forming section 62 of the printer 102 (Step S506) for printing, for example, a postscript (Step S507).

Next, the back cover sheet PB passes along the sheet transportation path 60 and is temporarily sent to the transportation rollers 66 and reversed (Step S508). The reversed back cover sheet PB passes along the transportation path 105 of the inserter set 104, is transported to the sheet processor 103, and is discharged face down onto the sample tray 85 (Step S509).

By carrying out the aforementioned steps, a bundle of insertion sheets and sheets S having images formed thereon can be obtained in a predetermined page order. Thereafter, the insertion sheets and the sheets S are bound by another process as in the first embodiment. Accordingly, the image-forming operation and the binding operation are completed.

According to the third embodiment, by integrally disposing the reverse section for reversing a back sheet PB integrally with the transportation path 57 near the image-forming section 62, the advantage that the size of the copying machine 1003 is reduced can be provided in addition to the advantages of the first embodiment.

Next, a description of a fourth embodiment of the present invention will be given.

Figure 6:
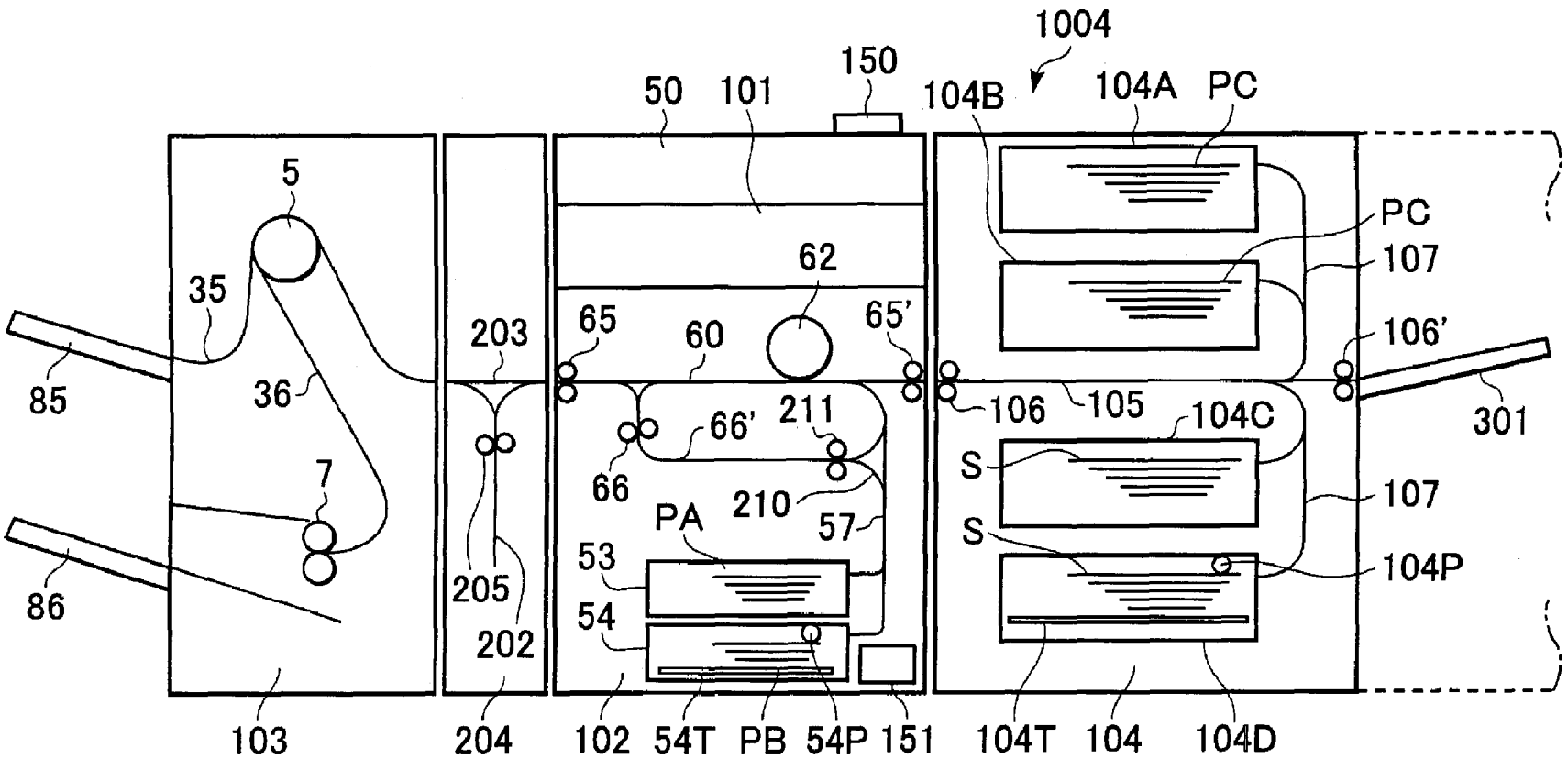
FIG. 6 is a schematic view of the structure of a copying machine, which is an example of an image-forming apparatus of a fourth embodiment of the present invention.

FIG. 6 is a schematic view of the structure of a copying machine, which is an example of an image-forming apparatus of a fourth embodiment of the present invention. In FIG. 6, the same reference numerals as those used in FIG. 1 refer to the same or corresponding parts.

In FIG. 6, reference numeral 1004 denotes a copying machine. In the fourth embodiment, a reversal path 210 and reversing rollers 211 of a reverse unit 204 serving as reverse section are integrally provided with a double-sided printing transportation path 66' disposed below an image-forming section 62. A flapper (not shown) is disposed at the entrance of the reversal path 210 of the reverse unit 204, so that sheets can be selectively transported to the image-forming section 62 by transporting them to the reversal path 210 or by passing them through the reverse unit 204. The reverse,unit 204 is removably disposed between a sheet processor 103 and a printer 102 comprising a reader 101.

Since the structures of inserters 104A to 104D of an inserter set 104 and sheet feeders 53 and 54 of the printer 102 have the same structures as those used in the first embodiment, they will not be described below.

In addition, it is possible to remove a manual feed tray 301 and connect another inserter to the inserter set 104. In this case, an inserter 1104 (see FIG. 1) having the same structure as the inserter set 104 including the inserters 104B to 104D may be used as the inserter. By this, it is possible to hold recording sheets S and insertion sheets of many types and sizes.

Next, an image-forming operation and a binding operation of the copying machine 1004 having this structure will be described.

Prior to the image-forming operation, cover sheets PA which are subjected to color copying and whose back sides are to have a table of contents or the like printed thereon are set face up in the sheet feeder 53. Back cover sheets PB whose back sides have printing on them and whose front sides are to be subjected to additional printing, such as printing of a postscript, are set face up in the sheet feeder 54. Slip sheets PC having printing thereon are set in the inserters 104A and 104B. Sheets S not having any printing thereon are set in the inserters 104C and 104D.

Next, an original P whose table of contents is copied on the back (bottom side) of a cover sheet PA set in the sheet feeder 53 is set in an original setting tray 50 of the reader 101 or a user performs a desired setting operation on the image-forming apparatus 1004 from an operating unit 150 in order to fetch data from a network.

Here, from the operating unit 150 to system controlling means 151, the user inputs information regarding whether the top side, the bottom side, both sides, or neither side of the cover sheets PA set in the sheet feeder 53, the back cover sheets PB set in the sheet feeder 54, the slip sheets PC set in the inserters 104A and 104B, and the unprinted sheets S set in the inserters 104C and 104D is to be printed. Thereafter, using the operating unit 150, the user instructs the image-forming apparatus to start carrying out the image-forming operation, thereby starting the image-forming operation.

Next, the steps of the image-forming operation will be described following the flowchart shown in FIG. 2.

(Cover Sheet Printing)

In order to print the table of contents on the back of the cover sheet PA set in the sheet feeder 53 based on the instruction from the user, at the same time that data concerning the table of contents of the original P is obtained from the reader 101 or the network, feeding of the cover sheet PA from the sheet feeder 53 to the transportation path 57 is started.

If the controlling means 151 determines that the cover sheet PA is an insertion sheet (Step S501), and that the table of contents is to be printed on the back side (that is, that there is an additional image printing operation (Step S503) and that the additional image printing side is the bottom side (Step S504)), the cover sheet PA is transported straight to the image-forming section 62 (Step S505) and the table of contents is printed (Step S507).

Then, the cover sheet PA having the table of contents printed on the back side in this way passes along a sheet transportation path 60 and through a path 203 of the reverse unit 204, is transported to the sheet processor 103, and is discharged face down onto a sample tray 85 (S509).

Here, it is possible to reverse the cover sheet PA after temporarily sending the cover sheet PA to the transportation rollers 66, transport the cover sheet PA back to the image-forming section 62 from the double-sided printing transportation path 66', superimpose characters upon each other for printing, reverse the cover sheet PA after temporarily sending the cover sheet PA to the transportation rollers 66 again, transport the cover sheet PA through the path 203 of the reverse unit 204 and to the sheet processor 103, and discharge the cover sheet PA face down onto the sample tray 85.

It is also possible to feed the cover sheet PA face down from a manual feed tray 301. In this case, the cover sheet PA is transported to a transportation path 105 by the transportation rollers 106'. Then, if the controlling means 151 determines that the cover sheet PA is an insertion sheet (Step S501), and that the table of contents is to be printed on the back side (that is, that there is an additional printing operation in Step S503 and that the additional image printing side is the bottom side in Step S504), the cover sheet PA is transported to the image-forming section 62 (Step S506), and the table of contents is printed (Step S507).

After the cover sheet PA having the table of contents printed on the back side has passed through the sheet transportation path 60 and the path 203 of the reverse unit 204, by transporting the cover sheet PA to the sheet processor 103, the cover sheet PA can be discharged face down onto the sample tray 85. By this, a thick cover sheet PA that cannot pass through the reverse unit 204 can be used.

(Printing of Text)

The printing of text is carried out by transporting the sheets S held by the inserters 104C and 104D to the image-forming section 62 through a transit path 107 and the transportation path 105 of the inserter set 104. Here, the controlling means 151 determines that the sheets S are not insertion sheets (Step S501), and a related image-forming step is carried out (Step S502).

In other words, when single-sided printing is carried out, an image is formed on one side of each sheet S at the image-forming section 62. Then, the sheets S pass along the sheet transportation path 60 and through the path 203 of the reverse unit 204, is transported to the sheet processor 103, and is discharged face down onto the sample tray 85 (Step S509).

When two-side printing is carried out, after an image has been formed on one side of each sheet S at the image-forming section 62, the sheets S pass along the sheet transportation path 60, and are temporarily sent to the transportation rollers 66 and reversed. The reversed sheets S are transported back to the image-forming section 62 from the double-sided printing transportation path 66', and the other side of each of the sheets S is printed. The sheets S having both sides printed are drawn into the reversal path 202 by the reversing rollers 205 of the reverse unit 204, and are reversed by reverse rotation of the reversing rollers 205. Thereafter, the sheets S are transported to the sheet processor 103, and discharged face down onto the sample tray 85 (Step S509).

(Insertion of Slip Sheets)

When printed slip sheets PC set in the inserter 104A and the inserter 104B are to be inserted between the cover sheet PA and the sheets with the printed text, the controlling means 151 starts feeding the slip sheets PC at a predetermined timing from the inserters 104A and 104B, and transports them to the transit path 107 and the transportation path 105.

Here, if the controlling means 151 determines that the slip sheets PC are insertion sheets (Step S501), and that there is no additional printing from data input by the user (Step S503), the slip sheets PC are transported straight to the image-forming section 62 and pass along the sheet transportation path 60 without forming an image thereon (Step S510). Then, the slip sheets PC are transported to the sheet processor 103 through the path 203 of the reverse unit 204, and are discharged face down onto the sample tray 85 (Step S509).

(Printing of Back Cover Sheet)

In order to perform additional printing, such as printing of a postscript, on the front of a back cover sheet PB set in the sheet feeder 54, at the same time that the data of the table of contents of the original P is fetched from the reader 101 or the network, the back cover sheet PB is transported to the transportation path 57 from the sheet feeder 54.

If the controlling means 151 determines that the back cover sheet PB is an insertion sheet (Step S501) and that printing of, for example, a postscript is to be performed on the front side (that is, that there is an additional printing operation in Step S503 and that the additional image printing side is not the bottom side in Step S504), the reversing rollers 211 draw the back cover sheet PB into the reversal path 210. Then, by reverse rotation of the reversing rollers 211, the back cover sheet PB is reversed and is transported to the image-forming section 62 (Step S506) for printing, for example, a postscript (Step S507).

Next, the back cover sheet PB passes along the sheet transportation path 60 and is drawn into the reversal path 202 by the reversing rollers 205 of the reverse unit 204. Then, the back cover sheet PB is reversed by reverse rotation of the reversing rollers 205 (Step S508). The reversed back cover sheet PB is transported to the sheet processor 103 and discharged face down onto the sample tray 85 (Step S509).

By carrying out the aforementioned steps, a bundle of insertion sheets and sheets S having images formed thereon can be obtained in a predetermined page order. Thereafter, the insertion sheets and the sheets S are bound by another process. Accordingly, the image-forming operation and the binding operation are completed.

By removably disposing the reverse unit 204 between the printer 102 and the sheet processor 103 as in the fourth embodiment, the fourth embodiment provides the advantage of making it possible for the copying machine 1004 to be disposed in a larger number of ways and for it to have a larger number of functions in addition to the advantages of the first embodiment. In addition, since the insertion sheets and the sheets S can be reversed by the reverse unit 204 having a large curvature R instead of by the double-sided printing transportation path 66', it is possible to prevent the insertion sheets from curling.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims.

What is claimed is:

1. An image forming apparatus comprising:

an image forming section for forming images on sheets;

a sheet supply section for holding insertion sheets to be inserted among the sheets having images formed thereon in the image forming section and supplying the insertion sheets to the image forming section; and a reverse section, disposed between said sheet supply section and said image forming section, for selectively reversing the insertion sheets received from the sheet supply section for supply to the image forming section.

2. An image forming apparatus according to claim 1, wherein said sheet supply section comprises an inserter set for holding and supplying the insertion sheets, and wherein said reverse section is disposed in a transportation path for transporting the insertion sheets to said image forming section from the inserter.

3. An image forming apparatus according to claim 1, wherein said sheet supply section comprises a recording sheet supply section for holding and supplying recording sheets, and wherein said reverse section is disposed in a transportation path for supplying the recording sheets to the image forming section from the recording sheet supply section.

* * * * *

UNITED STATES PATENT AND TRADEMARK OFFICE

CERTIFICATE OF CORRECTION

PATENT NO. : 7,020,430 B2
APPLICATION NO. : 10/454574
DATED : March 28, 2006
INVENTOR(S) : Toshihiko Kudo et al.

It is certified that error appears in the above-identified patent and that said Letters Patent is hereby corrected as shown below:

COLUMN 6:
Line 13, "inserter-set" should read --inserter set--.

Signed and Sealed this

Third Day of October, 2006

JON W. DUDAS
*Director of the United States Patent and Trademark Office*